United States Patent [19]

Damrau

[11] Patent Number: 4,503,804

[45] Date of Patent: Mar. 12, 1985

[54] EDGE SEAL ASSEMBLY FOR PAPER COATING APPARATUS

[75] Inventor: Wayne A. Damrau, Wisconsin Rapids, Wis.

[73] Assignee: Consolidated Papers, Inc., Wisconsin Rapids, Wis.

[21] Appl. No.: 458,490

[22] Filed: Jan. 17, 1983

[51] Int. Cl.[3] ..... B05C 5/02

[52] U.S. Cl. ..... 118/410; 118/413

[58] Field of Search ..... 118/407, 410, 413, 259; 427/356, 358

[56] References Cited

U.S. PATENT DOCUMENTS

| | | | |
|---|---|---|---|
| 3,418,970 | 12/1968 | Phelps et al. | 118/410 |
| 4,398,494 | 8/1983 | Alheid | 118/410 |
| 4,434,194 | 2/1984 | Geberd et al. | 118/413 X |

*Primary Examiner*—John P. McIntosh

*Attorney, Agent, or Firm*—Gary, Juettner & Pyle

[57] ABSTRACT

An improved edge seal assembly for an applicator for applying a coating liquid to a moving web of paper, wherein the applicator is of the type having a chamber for receiving the coating liquid and an elongate opening thereto for directing the liquid onto the web, the opening being formed between a front wall of the chamber and a doctor blade extending from the rear side of the opening to against the web, is characterized by a seal element sealed with the front wall and doctor blade in an end space therebetween, and a deckle beneath the seal element for closing off a selected portion of the side end of the opening. The seal element and the deckle are slidingly interconnected and can be independently adjusted laterally with respect to the opening.

13 Claims, 5 Drawing Figures

EDGE SEAL ASSEMBLY FOR PAPER COATING APPARATUS

BACKGROUND OF THE INVENTION

The present invention relates to an improved edge seal assembly for use with applicators of the trailing blade type for applying a coating liquid to a moving web of paper.

Conventional applicators of the trailing blade type include means for applying coating material to a paper web that is usually supported and carried by a resilient backing roll. Such applicators may include a chamber having an opening extending across and parallel to the web, together with a doctor blade located on the trailing side of the opening, which serves to level the coating, and a front wall extending from a leading side of the opening toward the web. Means are provided for supplying coating liquid to the chamber, and thence through the chamber opening and into an application zone defined between the front wall and doctor blade for application onto the web. To seal the end spaces between the front wall and doctor blade to prevent escape of coating material laterally of the web and out of the side ends of the application zone, edge dam means are provided thereat.

For applicators of the foregoing types, the edge dam means may comprise a flexible element at each end space for sealing with the front wall, doctor blade and paper web. Ideally, the edge dam absolutely prevents passage of any coating liquid to exterior of the application zone, thereby to maintain an uncoated margin along the side edge of the web and to prevent contamination of the web side edge, for example by eliminating excess coating material, which causes edge stickers when the web is wound on a reel.

However, in practice it is very difficult to prevent leakage of coating material past the edge dam, particularly with applicators of the type disclosed in Damrau et al U.S. Pat. No. 4,250,211, assigned to the assignee of the present invention. In that applicator, the opening from the chamber extends transversely across the application zone, and coating liquid under pressure in the chamber is introduced through the opening into the zone in copious excess to substantially completely and continuously fill the zone and a gap defined between the web and an upper edge of the front wall to form a liquid seal in the gap and thereby maintain the coating liquid in the zone under pressure for pressurized application onto the web. Because the coating liquid in the application zone is under pressure, and since the opening extends transversely across the zone so that coating liquid flowing through the side ends of the opening is directed against the edge dams, there is a direct pressure of coating liquid on the edge dams and an increased tendency for coating liquid to seep therepast.

OBJECTS OF THE INVENTION

An object of the present invention is to provide an improved edge dam assembly for an applicator for applying a coating liquid to a moving web of paper, which significantly decreases seepage of coating liquid beyond side ends of the applicator.

Another object is to provide such an edge dam assembly which includes a deckle for sealing off a selected portion of a side end of an opening through which coating liquid is introduced into an application zone, thereby to prevent direct impingement of coating liquid against an edge dam of the assembly.

A further object is to provide such an edge dam assembly in which the edge dam and deckle portions are independently adjustable to extend predetermined amounts into a side end of the application zone to accurately control the extent of an uncoated margin to be maintained on the paper web.

SUMMARY OF THE INVENTION

In accordance with the present invention, in an applicator for applying coating liquid to a moving web of paper, wherein said applicator is of the type having a body portion defining a chamber therein with an elongate opening thereto positionable generally below, adjacent to and transversely of the web, said chamber receiving coating liquid and directing the same through said opening and onto the web, there is provided an improved edge seal assembly at each side end of said opening. Each said edge seal assembly comprises edge seal means mounted in a side end of said opening generally below the web, sealed along side surfaces thereof with said body portion on opposite sides of said opening and extending at an upper surface thereof toward and closely adjacent to but spaced from the web for substantially sealing therewith, and an elongate deckle extended into said opening side end below said edge seal means to a position beyond said edge seal means and substantially sealed with said body portion on opposite sides of said opening. Said deckle closes said opening side end to said position beyond said edge seal means, so that coating liquid directed through said opening is not impinged directly onto said edge seal means, whereby leakage of coating liquid past said edge seal means is reduced.

In accordance with another embodiment of the invention, in an applicator for applying coating liquid to a moving web of paper, wherein the applicator is of the type having a body portion defining a chamber therein with an elongate opening thereto positionable generally below, adjacent to and transversely of the web, said chamber for receiving coating liquid and directing the same generally upwardly through said opening and onto the web, and a doctor blade extending from a rear side of said chamber opening against and substantially across the web, there is provided a deckle extended into and sealed with said opening along the length thereof, whereby said applicator may be used solely to doctor coating liquid applied on the web upstream of the applicator, said deckle then preventing coating liquid removed by said doctor blade from flowing into and contaminating said opening and chamber.

The foregoing and other objects, advantages and features of the invention will become apparent upon a consideration of the following detailed description, when taken in conjunction with the accompanying drawings.

DETAILED DESCRIPTION

Figure 1:
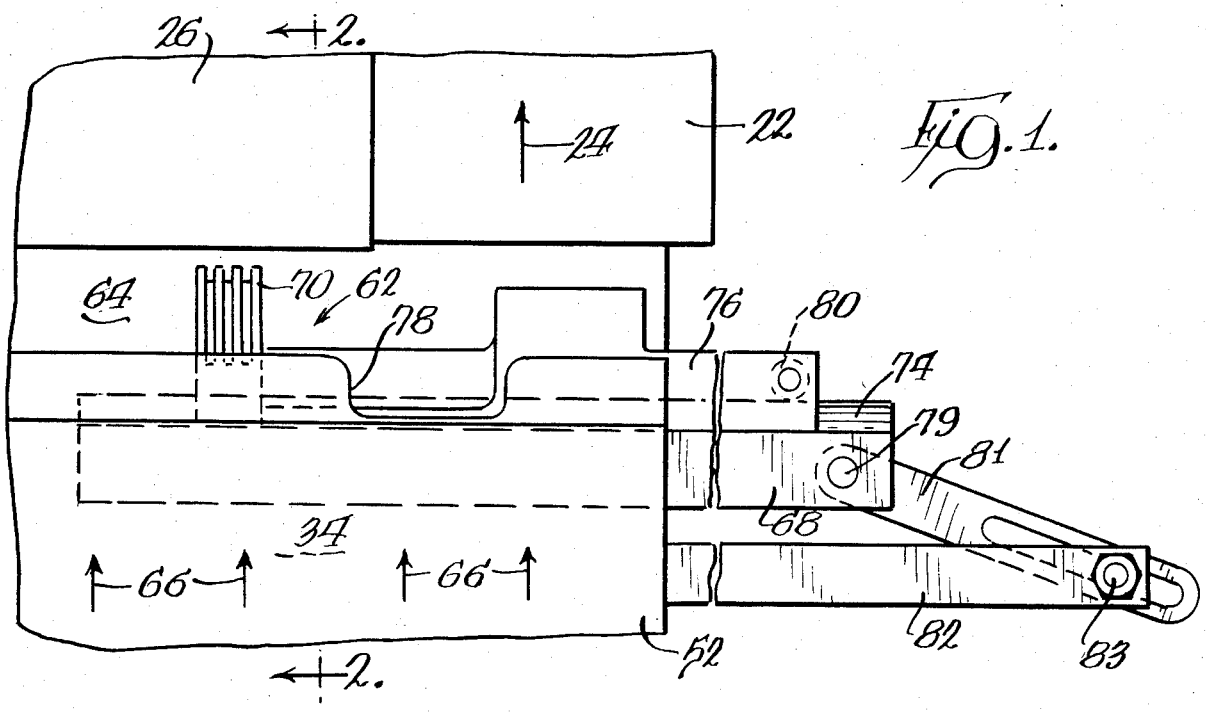
FIG. 1 is a longitudinal front view of one side end of a paper coating applicator, showing an edge dam assembly in accordance with the invention mounted on the applicator and the orientation of the assembly with respect to a paper web carried on a backing roll.
Figure 2:
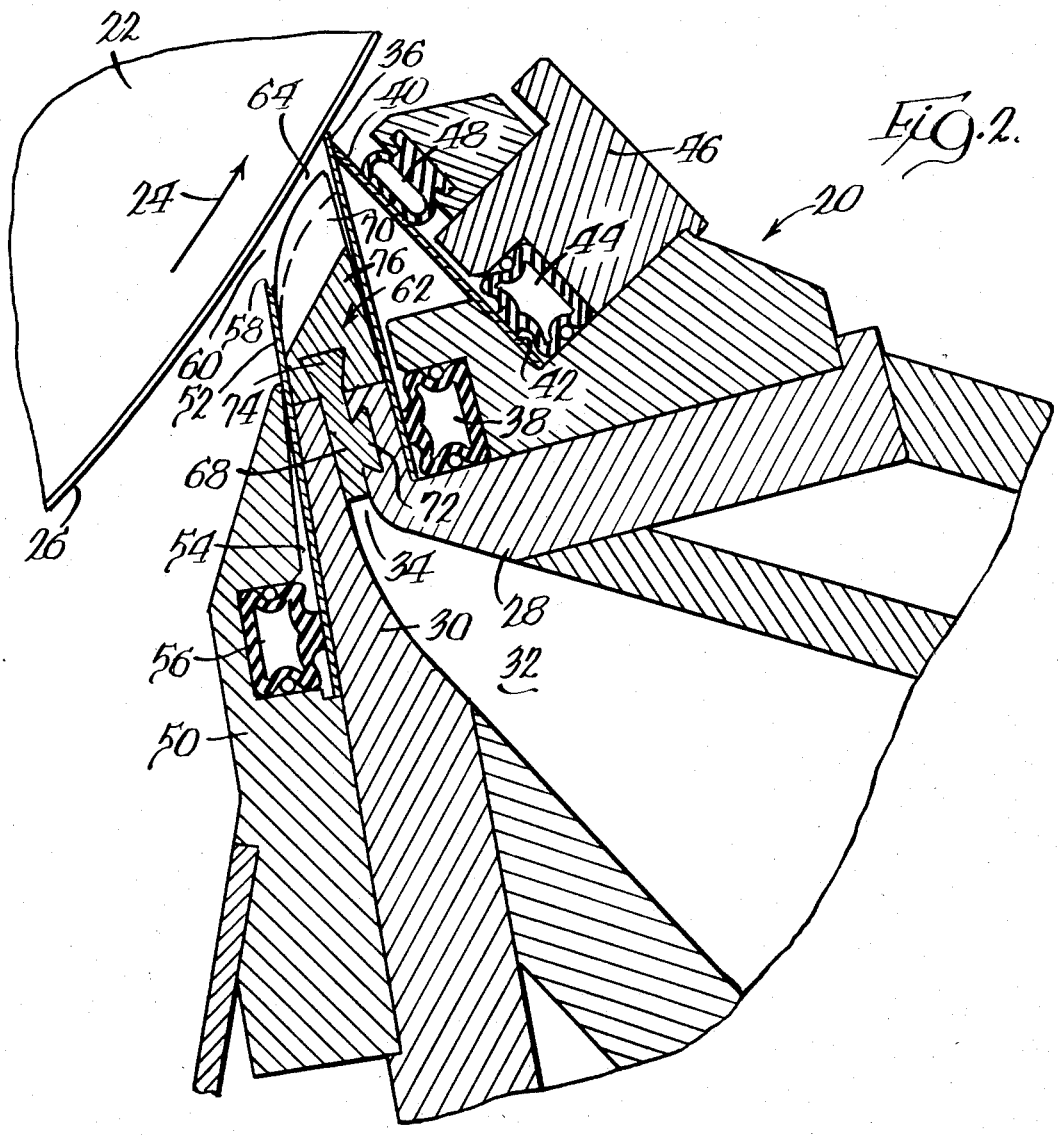
FIG. 2 is a cross sectional side elevation view, taken substantially along the lines 2—2 of FIG. 1, illustrating the manner in which the edge dam assembly is mounted on the applicator.

Referring to FIGS. 1 and 2, there is shown an applicator of a type with which an edge dam or edge seal assembly structured in accordance with one embodiment of the invention is particularly adapted for use. The applicator comprises a main beam, indicated generally at 20, extending parallel to and coextensively with a movable support or backing roll 22 which rotates in the direction shown by an arrow 24 and supports a web of paper 26 during its travel through the applicator. The beam has walls 28 and 30 forming a chamber 32 therebetween for reception of liquid coating material under pressure, and although not shown the sides of the chamber are closed by side walls extending between the front and rear walls. The front and rear walls converge upwardly toward one another and define a metering slot, orifice or opening 34 which extends upwardly adjacent to, substantially transversely across and facing the web supporting surface of the roll 22, and the front wall is pivotally mounted relative to the rear wall to permit the chamber to be opened for cleaning and also to adjust the width of the metering slot.

A flexible doctor blade 36 is held against a rearward surface of the wall 28 by a pneumatic tube 38 which is expandable by the introduction of fluid under pressure therein to press against the doctor blade. The doctor blade extends beyond the metering slot 34 into engagement with the web of paper supported on the roll and serves to meter and level the coating applied on the surface of the web. To urge the doctor blade against the web, a loading device therefor includes a flexible steel loading blade 40 seated at its lower end against a wall 42 of the coater head or main beam 20, and held against the wall by an inflatable pneumatic tube 44 extending along and within a loading blade housing 46 mounted on the main beam. To urge the loading blade against the doctor blade to load the same, a second pneumatic tube 48 at an upper end of the housing 46 is inflatable to engage the loading blade with a selected force determined by the pressure of fluid within the tube. While for the purpose of simplifying the drawing the loading blade housing is illustrated as being mounted in fixed angular relationship to the main beam, it is to be understood that, although not shown, a suitable adjusting means may be provided to vary the angular relationship of the housing with respect to the main beam, and therefore the angle of the loading blade with respect to the doctor blade.

Supported between a front surface of the front wall 30 and a mounting member 50 is an orifice plate 52. The orifice plate is received within a slot 54 between the front wall and mounting member, and releasably secured therein by a pneumatic tube 56, whereby upon release of pressure in the pneumatic tube the orifice plate may be slid from the slot transversely of the head for repair or replacement. The orifice plate extends substantially transversely across the backing roll 22 and beyond the metering slot 34, and converges toward the roll supported web and the coater blade. The orifice plate has a free upper edge 58 which is juxtaposed to but slightly spaced from the web, such that a space or gap 60 between the edge and the web is relatively small and less than one inch.

At each of the two ends of the applicator, the space between the coater blade 36 and the orifice plate 52 is sealed off by an edge dam assembly, indicated generally at 62 and configured in accordance with one embodiment of the invention. Each edge dam assembly sealingly engages the upper edges of the walls 28 and 30, the blade and the orifice plate, closely approaches the roll supported web 26 and closes off the side end of the metering slot 34, thereby to define a coating material application zone 64.

In operation of the applicator, coating liquid is supplied under sufficient pressure and in sufficient quantity to completely fill the chamber 32, the metering slot 34 and the secondary chamber or application zone 64 defined by the doctor blade 36, the orifice plate 52 and the edge seal assemblies 62, to cause a continuous, copious flow of coating material reversely of the direction of web travel through the narrow space or gap 60 defined between the upper end 58 of the orifice plate and the web. This forms a liquid seal between the edge and the web, so that coating liquid within the application zone is maintained under pressure, thereby to cause the coating liquid to be applied to the web in a very narrow transverse band under a constant positive pressure. The copious excess of coating liquid that flows through the orifice gap 60 forms a non-abrasive liquid seal with the web at the forward edge of the application zone; causes the coating liquid in the application zone to be maintained under pressure and to be applied to the web under pressure; seals off the forward edge of the application zone against entry of air and foreign matter; strips air from the high speed web and prevents such air from causing streaks or skips in the coating on the web; and causes the doctor blade to doctor the coating liquid while the liquid is held under pressure.

The coating applicator thus far described, except for the specific structures of the edge dam assembly, the doctor blade loading means and the mounting for the orifice plate, is described in detail in U.S. Pat. No. 4,250,211, assigned to the assignee of the present invention, the teachings of which are specifically incorporated herein by reference. For a more specific description of the applicator, reference is made to said patent.

As previously described, the metering slot or opening 34 extends upwardly adjacent to, transversely across and facing the web supporting surface of the roll 22. In consequence, coating liquid introduced through the metering slot into the application zone 64 flows through the slot and enters the zone along the longitudinal extent thereof generally in the direction shown by arrows 66. With conventional edge seal assemblies, coating liquid introduced into the application zone at the side ends of the zone and metering slot would be flowed or impinged directly against the edge seal thereat which, together with the pressure of coating liquid in the zone, would promote leakage of coating liquid past the edge seal. However, because of the particular construction of the edge seal assembly of the invention, leakage of coating liquid past the side ends is significantly minimized.

Figure 3:
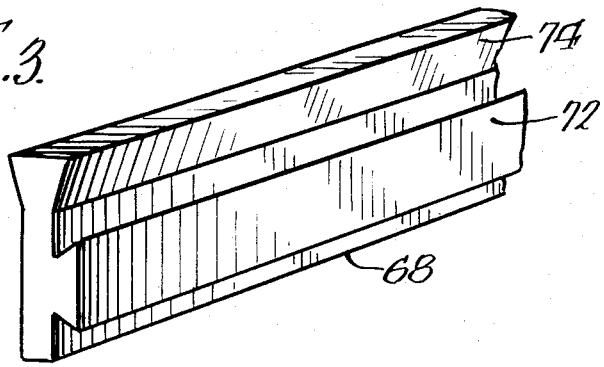
FIG. 3 is a perspective view of a deckle portion of the edge dam assembly.

More particularly, it being understood that an edge seal assembly 62 according to the invention is at each side end of the metering slot 34 and application zone 64, the assembly generally comprises an internal orifice deckle 68 and an edge seal 70. The internal orifice deckle is shown in greater detail in FIG. 3, and includes an elongate body portion having dovetails 72 and 74 respectively formed along the side and the top thereof. A dovetail seat for receiving the dovetail 72 is formed in the wall 28 of the coater head within and along the length of the metering slot, such that the deckle may be slidingly extended into the slot to seal off a selected length of the side end thereof. When the deckle is extended into the side end of the metering slot, the dovetail 74 extends above the upper surfaces of the front and rear walls 30 and 28.

The edge seal 70, which advantageously is of a type similar to that described in Damrau U.S. Pat. No. 4,327,662, the teachings of which are specifically incorporated herein by reference, is carried at an end of an elongate body portion 76 for supporting and mounting the same on the deckle 68. To that end, a dovetail seat is formed in the lower surfaces of the edge seal and body portion for receiving the deckle dovetail 74, such that the edge seal and body portion may be joined with and slid along the deckle to position the edge seal at a selected location with respect to a side edge of the paper web 26. When mounted on the deckle, the bottom surfaces of the body portion and edge seal sealingly engage the upper edges of the walls 28 and 30, the side surfaces of the edge seal sealingly engage the doctor blade 36 and orifice plate 52 and the upper end of the edge seal extends closely adjacent to but slightly spaced from the web 26, thereby to substantially seal off the space at the side end of the application zone 64. The manner in which the edge seal operates to minimize leakage of coating liquid out of the side end of the application zone, and provide a dry and uncoated margin along the edge of the paper web, is described in detail in said U.S. Pat. No. 4,327,662.

It may now be appreciated how the edge seal assembly 62 significantly minimizes coating liquid leakage out of the side ends of the metering slot and application zone. The deckle 68 is adjustable to extend a selected amount into and seal off the side end of the metering slot 34. Thus, since the edge seal 70 and the deckle may be independently adjusted at the side ends of the applicator, the edge seal may first be extended to a position providing a selected width of uncoated margin along the side edge of the paper web, and the deckle then extended, as shown in FIG. 1, to a point slightly beyond the edge seal. Since the deckle seals off the metering slot, by extending it into the slot slightly beyond the edge seal, the size or length of the slot may be controlled so that it is closed beneath and to a point slightly beyond the edge seal, and opens into the application zone only at a point beyond the edge seal. Consequently, coating liquid introduced into the application zone through the metering slot is not impinged directly against the edge seal, with the result that coating liquid adjacent the edge seal is relatively tranquil and leakage of the coating liquid therepast is minimized. It is understood, of course, that since the edge seal must be maintained slightly spaced from the web, a limited amount of coating liquid will seep therepast, and to that end cutout areas 78 are provided in opposite side ends of the orifice plate 52 outwardly of the edge seals to accommodate controlled runoff of any coating liquid that seeps past the edge seals.

Accordingly, the invention provides an improved edge seal assembly wherein a deckle and edge seal are independently laterally adjustable within the side ends of the metering slot and application zone to provide an uncoated margin of selected width along the side edge of the paper web. To adjust the deckle and edge seal, the applicator front wall 30 is pivoted away from the wall 28, the deckle and edge seal are adjusted and the front wall is then returned to its position against the deckle, with the dovetail 72 preventing the edge seal assembly from falling out of the applicator when the front wall is pivoted away from the deckle during adjustment. To facilitate adjustment of the deckle and edge seal laterally of the coater head, the same are provided with respective dowel pins 79 and 80 for gripping by an operator, and to prevent lateral movement of the deckle after adjustment, a slotted link 81 is pivotally connected at one end with the dowel pin 79 and is releasably fastened toward an opposite end with an extension 82 of the coater head by means of a bolt 83 extending through a slot therein. The edge seal is secured in place after adjustment by means of friction between it and the deckle, which is sufficient to prevent pressure of coating liquid from moving the edge dam outwardly of the coater, but yet allows the edge dam to be moved by an operator gripping the dowel pin 80 for adjustment of the same during operation of the coater.

Figure 4:
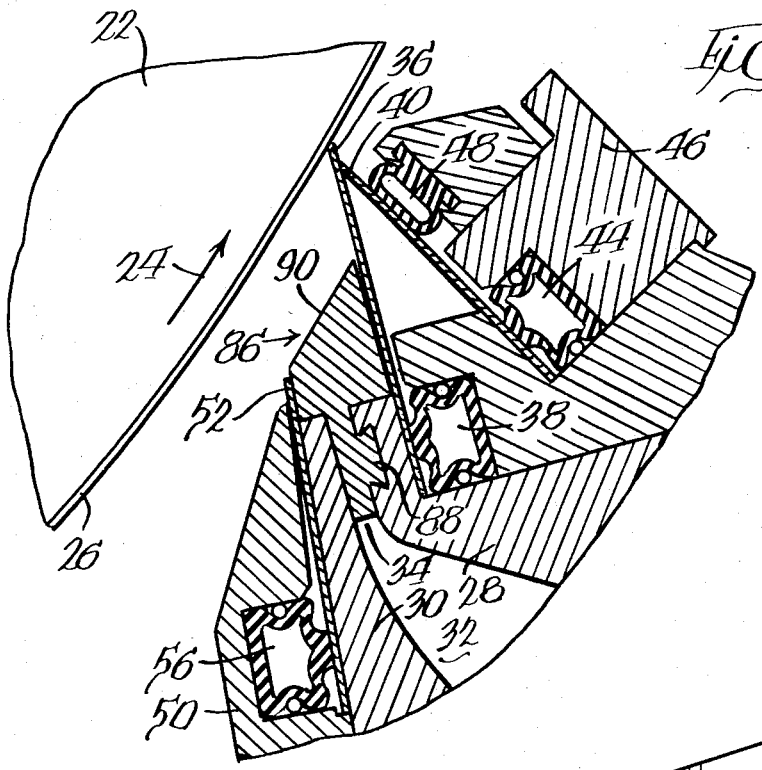
FIG. 4 is a cross sectional side elevation view of another embodiment of the invention, illustrating a deckle on an applicator for sealing off an inlet opening to an application zone thereof, so that the applicator may be used solely to doctor coating liquid applied on a web upstream of the applicator.
Figure 5:
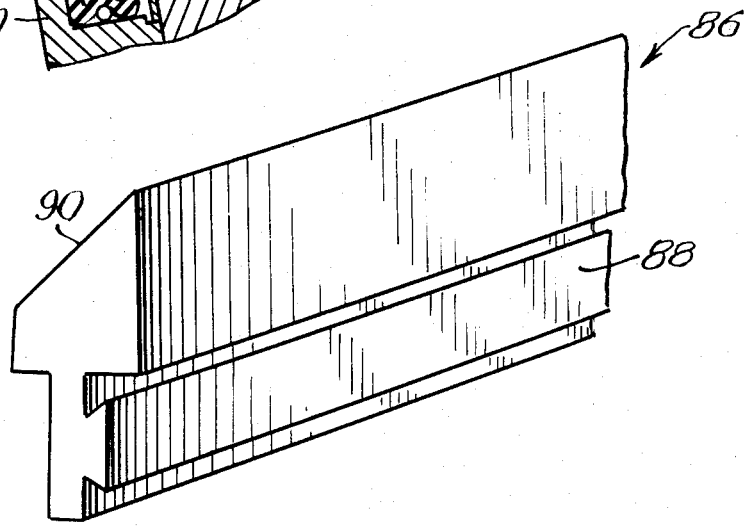
FIG. 5 is a perspective view of the embodiment of deckle shown in FIG. 4.

FIGS. 4 and 5 illustrate another embodiment of the invention, wherein an internal orifice deckle is used to seal the entire length of the metering slot 34 when the applicator is to be used solely for the purpose of doctoring a coating applied on the paper web by a downstream dip roll applicator. In this case, the deckle comprises a relatively elongate body, indicated generally at 86, which has a length sufficient to extend along the entire length of the metering slot. The deckle may have a dovetail 88 extending along its entire length, or it may have a plurality of button-like dovetails spaced at 6" to 12" centers, and an upper surface 90 of the deckle is tapered.

In use of the deckle, the dovetail 88 is extended into a dovetail seat formed in the wall 28 within and along the entire length of the metering slot 34, so that the deckle may be slidingly extended into and along the entire length of the metering slot to seal the same and, therefore, the lower chamber 32. When in position, the deckle 86 seals with the doctor blade 36 and the orifice plate 52, whereby the applicator is then adapted to simply meter and level coating liquid applied on the paper web 26 by a downstream dip roll applicator (not shown). Coating liquid removed by the doctor blade flows down the doctor blade, across the tapered surface 90 of the deckle, over the upper edge of the orifice plate 52 and down the front wall of the mounting member 50 for collection, without any coating liquid flowing into and contaminating the now sealed metering slot 34 and chamber 32. For the purpose of the present embodiment of invention, the orifice plate 52 is selected to have a height which positions its upper edge slightly below the lower end of the tapered deckle surface 90, so that the orifice plate does not impede the flow of coating liquid off of the deckle.

The invention thus provides improved seal means for a short dwell time applicator of the type disclosed in said U.S. Pat. No. 4,250,211. When the edge seal and deckle are used in combination, the deckle is adjustable to close off a selected amount of the side end of the metering slot, thereby to control the overall length of the slot and prevent coating liquid introduced therethrough from being impinged directly against the edge seal. On the other hand, using the deckle by itself for the purpose of sealing the entirety of the length of the metering slot enables the applicator to be used solely to doctor a liquid coating applied on the paper web by a downstream dip roll applicator, whereby the applicator is enabled to serve a dual purpose and the need for a separate doctoring mechanism is eliminated.

While embodiments of the invention have been described in detail, various modifications and other embodiments thereof may be devised by one skilled in the art without departing from the spirit and scope of the invention, as defined in the appended claims.

What is claimed is:

1. In an applicator for applying a coating liquid to a moving web of paper carried through an application zone, wherein the applicator is of the type comprising a body portion having a chamber therein with an elongate metering slot therefrom defined between upper ends of front and rear walls of said body portion and extending substantially transversely across the web; a doctor blade extending from said rear wall substantially transversely across and against the web; an orifice plate extending from said front wall substantially transversely across and toward but spaced from the web to define a gap therewith; and means for introducing coating liquid under pressure into said chamber and through said metering slot into an application zone for application onto the web, an improved sealing means at each side end of said metering slot and application zone, said sealing means, doctor blade and orifice plate defining said application zone therebetween and above said metering slot, each said sealing means comprising edge seal means sealed along side surfaces thereof with said doctor blade and orifice plate, sealed along a lower surface thereof with said upper ends of said front and rear walls, extending at an upper surface thereof toward the web for substantially sealing therewith and adjustably mounted for movement into and out of said application zone side end, and an elongate deckle within said metering slot, separate from and movable with respect to said edge seal means, adjustably extendable along and within said metering slot below said edge seal means a selected distance with respect to and inwardly of said edge seal means and substantially sealed with said body portion front and rear walls within and on opposite sides of said metering slot, said deckle closing said metering slot for said selected distance inwardly of said side end thereof to control the length of said metering slot so that said metering slot is open only inwardly of said edge seal means, whereby coating liquid is directed through said metering slot into said application zone only inwardly of said edge seal means and is not directly impinged onto said edge seal means as it exits said metering slot so that leakage of coating liquid past said edge seal means is reduced.

2. In an applicator as in claim 1, wherein said deckle is slidably and sealingly connected with at least one of said front and real walls toward said upper end thereof within said metering slot for adjustable extension within and along said metering slot.

3. In an applicator as in claim 2, wherein a lower end of said edge seal means and an upper end of said deckle are slidably mechanically interconnected for adjustable movement of said edge seal means along said deckle to a selected position beneath the web, whereby said edge seal means and said deckle are independently adjustable to extend to selected positions within said application zone and metering slot side ends.

4. In an applicator as in claim 3, including means for releasably securing said deckle and edge seal means against movement both with respect to each other and to said body portion, whereby the same may be fastened in adjusted positions.

5. In an applicator as in claim 1, wherein said edge seal means and said deckle are slidably mechanically interconnected for movement of said edge seal means with respect to said deckle to a selected position beneath the web.

6. In an applicator as in claim 1, wherein said edge seal means includes an edge seal carried at an end of an elongate support, said edge seal seals along opposite side surfaces thereof with said doctor blade and orifice plate and extends at an upper surface thereof toward the web for substantially sealing therewith, said elongate support extends from said edge seal to a position outwardly of said application zone side end and said edge seal and elongate support seal along bottom surfaces thereof with said upper ends of said front and rear walls to opposite sides of said metering slot, and said deckle is extendable within and along said metering slot side end immediately beneath and in sealed relationship with said edge seal means to a position within said metering slot inwardly of said edge seal.

7. In an applicator as in claim 6, wherein said deckle is slidably and sealingly connected with at least one of said front and rear walls toward said upper end thereof within said metering slot and along an upper end thereof with a lower end of said edge seal means, whereby said edge seal means and said deckle are independently slidably adjustable to extend to selected positions within said application zone and metering slot side ends.

8. In an applicator as in claim 7, including means for releasably securing said deckle and edge seal means against movement both with respect to each other and with said body portion, whereby the same may be fastened in adjusted positions within said metering slot and application zone side ends.

9. In an applicator as in claim 7, wherein said deckle has a first dovetail on a rearward side thereof and is slidably and sealingly connected with said body portion rear wall toward said upper end thereof by means of a dovetail seat formed therein within said metering slot, and has a second dovetail on said upper end thereof and is slidably and sealingly connected with said edge seal means by means of a dovetail seat extending along the length of said lower end of said edge seal means.

10. In combination with an applicator for applying coating liquid to a moving web of paper, wherein the applicator is of the type having a body portion defining a chamber therein with an elongate metering slot therefrom defined between upper ends of front and rear walls of said body portion and positionable generally below, adjacent to and transversely across the web, said chamber for receiving coating liquid and directing the same generally upwardly through said metering slot and onto the web, and a doctor blade extending from said rear wall against and substantially transversely across the web, an elongate deckle extended within said metering slot and along the entirety of the length thereof, said deckle completely sealing said metering slot so that said applicator may be used solely to doctor coating liquid applied on the web upstream of said applicator, said deckle then blocking said metering slot to prevent coating liquid removed by said doctor blade from flowing into and contaminating said metering slot and chamber.

11. The combination as in claim 10, wherein said deckle is slidably mechanically connected with at least one of said front and rear walls toward said upper end thereof within said metering slot, so that said deckle may be slidingly inserted into or removed from a side end of said metering slot.

12. The combination as in claim 11, wherein said deckle seals along a rear surface thereof with said doctor blade and has a tapered upper surface which slopes downwardly away from said doctor blade for conveying coating liquid removed by said doctor blade to a forward side of said applicator.

13. The combination as in claim 11, wherein said at least one of said front and rear walls has a dovetail seat formed therein within and along the length of said metering slot and said deckle has at least one dovetail along at least one side thereof receiving in said dovetail seat, whereby said deckle may be introduced into a side end of said metering slot with said dovetail received in said dovetail seat and be slidingly extended into and along the length of said metering slot, and may be removed from said metering slot through said side end thereof.

* * * * *